US007637495B2

(12) United States Patent
Motoyoshi et al.

(10) Patent No.: US 7,637,495 B2
(45) Date of Patent: Dec. 29, 2009

(54) AUTO DOCUMENT FEEDER PAPER FEED TRAY AND IMAGE READING APPARATUS

(75) Inventors: Koichi Motoyoshi, Kyoto (JP); Ryuichi Onaka, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 406 days.

(21) Appl. No.: 11/550,474

(22) Filed: Oct. 18, 2006

(65) Prior Publication Data

US 2007/0176352 A1 Aug. 2, 2007

(30) Foreign Application Priority Data

Jan. 27, 2006 (JP) ..... 2006-018701

(51) Int. Cl.
*B65H 1/00* (2006.01)

(52) U.S. Cl. ..... 271/161; 271/145; 271/171; 399/393

(58) Field of Classification Search ..... 271/161, 271/145, 171; 399/393
See application file for complete search history.

(56) References Cited

U.S. PATENT DOCUMENTS

| | | | | |
|---|---|---|---|---|
| 4,005,794 | A * | 2/1977 | Lundquist | 271/161 |
| 4,457,507 | A * | 7/1984 | Ishikawa et al. | 271/121 |
| 5,412,462 | A | 5/1995 | Matsuo et al. | |
| 6,040,919 | A * | 3/2000 | Iwata et al. | 358/400 |
| 6,113,093 | A | 9/2000 | Morinaga et al. | |
| 6,543,761 | B2 * | 4/2003 | Endo | 271/110 |
| 6,559,977 | B2 * | 5/2003 | Sasai et al. | 358/400 |
| 6,908,244 | B2 * | 6/2005 | Cook et al. | 400/624 |
| 2002/0067513 | A1 | 6/2002 | Sasai et al. | |
| 2004/0022452 | A1 | 2/2004 | McCoy | |
| 2004/0056413 | A1 * | 3/2004 | Shirakura et al. | 271/145 |
| 2006/0151938 | A1 * | 7/2006 | Bauvin et al. | 271/113 |

FOREIGN PATENT DOCUMENTS

| | | | |
|---|---|---|---|
| EP | 0575884 | A1 | 12/1993 |
| JP | 10-265097 | A | 10/1998 |
| JP | 2003-201046 | A | 7/2003 |
| JP | 2004-35205 | A | 2/2004 |

OTHER PUBLICATIONS

Official communication issued in the counterpart European Application No. 06021570.4, mailed on Jun. 4, 2007.
Official communication issued in counterpart Japanese Application No. 2006-018701, mailed on Feb. 10, 2009.

* cited by examiner

*Primary Examiner*—Patrick H Mackey
*Assistant Examiner*—Howard Sanders
(74) *Attorney, Agent, or Firm*—Keating & Bennett, LLP

(57) ABSTRACT

In an automatic document feeder (ADF) paper feed tray, in a state where a sheet is placed, a center portion of the sheet in the width direction is supported by a first support portion, an outside portion of the sheet in the width direction is supported by a second support portion, and both side portions of the sheet in the width direction hang down substantially uniformly. By this arrangement, the ADF paper feed tray can be made small. As a result, in the case where the sheet is discharged below the ADF paper feed tray, the confirmation of the discharged sheet can be facilitated.

14 Claims, 2 Drawing Sheets

AUTO DOCUMENT FEEDER PAPER FEED TRAY AND IMAGE READING APPARATUS

BACKGROUND OF THE INVENTION

1. Field of the Invention

The present invention relates to an ADF paper feed tray connected to an ADF (Auto Document Feeder) for supplying a sheet to an image reading apparatus such as, for example, a multi function peripheral or a scanner, and an image reading apparatus including the same.

2. Description of the Related Art

An auto document feeder (hereinafter suitably referred to as "ADF") provided in an image reading apparatus, such as a multi function peripheral or a scanner, is connected with an ADF paper feed tray on which sheets to be supplied to the ADF are placed. The sheets placed on the ADF paper feed tray are sequentially supplied to the ADF, and then are discharged below the ADF paper feed tray.

The size of the ADF paper feed tray is designed to be relatively large in order to sufficiently hold the sheets, and therefore the unsightliness of the large ADF paper feed tray cannot be avoided. Additionally, there arises another problem that when the size of the ADF paper feed tray becomes large, it becomes difficult to see the sheet discharged below the ADF paper feed tray.

SUMMARY OF THE INVENTION

In order to overcome the problems described above, preferred embodiments of the present invention provide an ADF paper feed tray in which unsightliness is minimized and the confirmation of a sheet discharged below the ADF can be facilitated, and an image reading apparatus including the ADF paper feed tray.

A first preferred embodiment of the present invention includes an ADF paper feed tray connected to an automatic document feeder provided in an image reading apparatus, which includes a first support portion that supports a center portion of a sheet in a width direction of the sheet from below in a state where the sheet is placed, and causes both side portions of the sheet in a width direction to hang down substantially uniformly.

According to the first preferred embodiment of the present invention, in the state where the sheet is placed, the center portion of the sheet in the width direction is supported from below by the first support portion. Simultaneously, both side portions of the sheet in the width direction hang down substantially uniformly. By this arrangement, the first support portion itself can be made small, and the ADF paper feed tray including the first support portion can also be made small. As a result, the unsightliness of the ADF paper feed tray can be minimized. Since the ADF paper feed tray is made small, in the case where the sheet is discharged below the ADF paper feed tray, it is possible to facilitate the confirmation of the discharged sheet. Further, since both side portions of the sheet in the width direction hang down uniformly in the state where the sheet is placed, the sheet is deformed convexly in the width direction, and stiffness is provided to the sheet, and therefore, it is possible to prevent the sheet from being supplied in an inclined state to the automatic document feeder. By this arrangement, skew of the sheet can be prevented and poor image formation can be prevented.

A second preferred embodiment of the present invention includes a second support portion mounted on the first support portion to support, from below, an outside portion of the sheet positioned outside the center portion of the sheet in the width direction of the sheet, wherein the second support portion is made of a transparent or semi-transparent material.

According to the second preferred embodiment of the present invention, the second support portion is mounted on the first support portion to support the outside portion of the sheet positioned outside the center portion of the sheet in the width direction of the sheet, and the second support portion is made of the transparent or semi-transparent material, and accordingly, the unsightliness of the ADF paper feed tray can be further minimized. Since light is transmitted through the second support portion, in the case where the sheet is discharged below the ADF paper feed tray, it is possible to further facilitate the confirmation of the discharged sheet. Particularly, since the second support portion is mounted on the first support portion, the foregoing effect becomes more remarkable as compared with an ADF paper feed tray of a structure in which a transparent member is provided at an internal portion or a portion of an outer periphery of the ADF paper feed tray.

A third preferred embodiment of the present invention includes a cutout that is provided in a portion of the second support portion of the ADF paper feed tray.

According to the third preferred embodiment of the present invention, since the cutout is provided in the portion of the second support portion, the sheet can be easily placed on the ADF paper feed tray by inserting the user's hand into a gap formed by the cutout. Additionally, the sheet placed on the ADF paper feed tray can be easily taken out from the ADF paper feed tray by inserting the user's hand into the gap formed by the cutout.

According to a fourth preferred embodiment of the present invention, the first support portion is provided with plural sensor portions to detect a length of the sheet in a sheet transport direction of the ADF paper feed tray.

According to the fourth preferred embodiment of the present invention, since the first support portion is provided with the plural sensor portions to detect the length of the sheet in the sheet transport direction, the length of the sheet placed on the first support portion can be detected. By this arrangement, in the case where image information of the sheet placed on the first support portion is printed onto a printing paper, a printing paper with a suitable size can be easily specified. Particularly, since the plural sensor portions are provided, even in the case where sheets of various sizes are placed on the first support portion, the size of the sheet placed on the first support portion can be certainly detected.

According to a fifth preferred embodiment of the present invention, the sensor portions are respectively provided at portions of the first support portion corresponding to the center portion of the sheet and the portions of the first support portion corresponding to different sized sheets in the transport direction of the ADF paper feed tray.

According to the fifth preferred embodiment of the present invention, since the sensor portions are respectively provided at the portions of the first support portion corresponding to the center portion of the sheet and the portions of the first support portion corresponding to different sized sheets in the transport direction, even in the case where the sheet is placed on the first support portion so that the center of the sheet placed on the first support portion deviates from a center of the first support portion, the size of the sheet can be certainly detected.

A sixth preferred embodiment of the present invention includes an image reading apparatus including the ADF paper feed tray according to one of the previous preferred embodiments.

According to the sixth preferred embodiment of the present invention, since the ADF paper feed tray according to a previous preferred embodiment is provided, the image reading apparatus can be obtained in which the unsightliness is minimized and the confirmation of the sheet discharged below can be facilitated.

According to the preferred embodiments of the present invention, the unsightliness of the ADF paper feed tray is minimized, and the confirmation of the sheet discharged below can be facilitated.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Next, an ADF paper feed tray according to a preferred embodiment of the present invention and an image reading apparatus including the same will be described with reference to the drawings.

Figure 1:
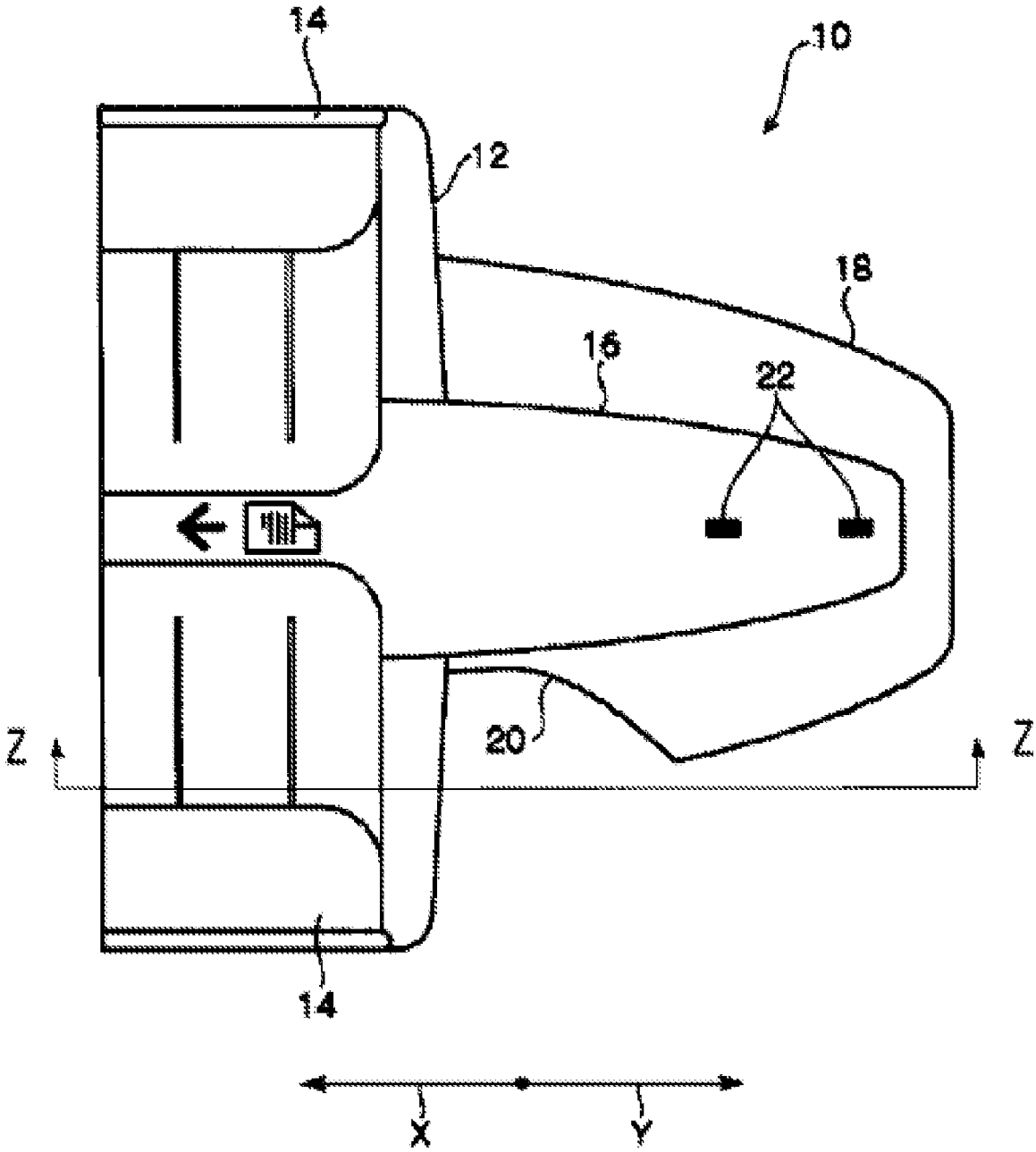
FIG. 1 is a plan view of an ADF paper feed tray of a preferred embodiment of the present invention.
Figure 2:
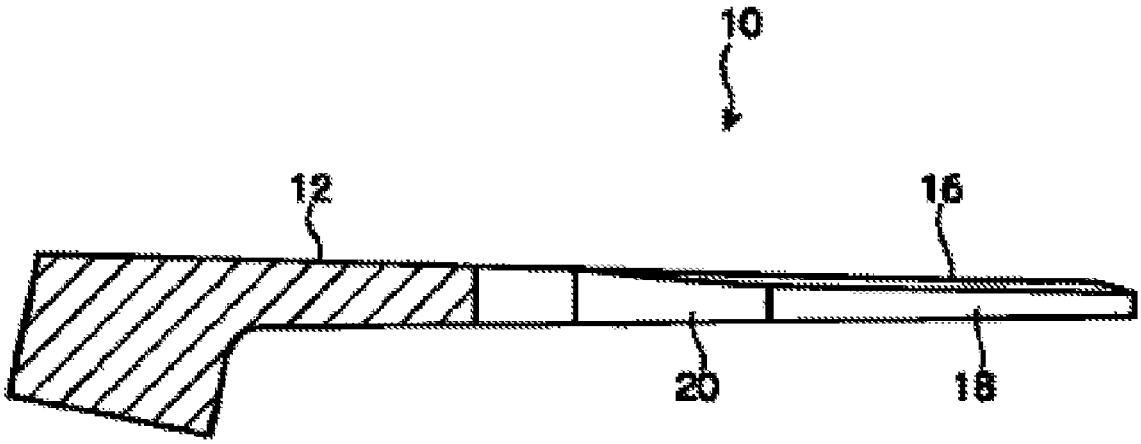
FIG. 2 is a sectional view taken along Z-Z of the ADF paper feed tray of the preferred embodiment shown in FIG. 1.

As shown in FIG. 1 and FIG. 2, an ADF paper feed tray 10 is connected to an automatic document feeder (ADF) provided in an image reading apparatus. The ADF paper feed tray 10 includes a tray body portion 12. A sheet to be supplied to the ADF is placed on the upper surface of the tray body portion 12, and the lower portion of the sheet (especially a portion of the sheet at a front side in a transport direction) is supported by the tray body portion 12. A guide portion 14 to guide both sides of the sheet in the width direction is arranged to be movable in the width direction on the upper surface of the tray body portion 12. An ADF (not shown) is connected to the front side (arrow X direction side in FIG. 1) of the tray body portion 12.

A first support portion 16 is connected to a center portion in the width direction of the tray body portion 12 at the back side (arrow Y direction side in FIG. 1) of the tray body portion 12. By this arrangement, in the state where a sheet is placed on the ADF paper feed tray 10, a center portion of the sheet in the width direction is supported from below by the first support portion 16.

A second support portion 18 is mounted on the first support portion 16 to support, from below, an outside portion of the sheet positioned outside the center portion of the sheet supported from below by the first support portion 16. By this arrangement, when the sheet is placed on the ADF paper feed tray 10, the center portion of the sheet in the width direction is supported from below by the first support portion 16, and the outside portion of the sheet positioned outside the center portion of the sheet is supported from below by the second support portion 18. Further, both side portions in the width direction of the sheet protrude to the outside from the second support portion 18 and hang down substantially uniformly.

The second support portion 18 is preferably substantially U-shaped when viewed in a plan view, and a cutout 20 into which the user's hand can be inserted is formed in a portion thereof. The second support portion 18 is preferably made of a transparent or semi-transparent material, for example, a resin or plastic.

As shown in FIG. 1, plural sensor portions 22 to detect the length of the sheet in the sheet transport direction are provided on the upper surface of the first support portion 16. In more detail, the sensor portions 22 are respectively provided at portions of the first support portion corresponding to the center portion of the sheet in the width direction and the portions of the first support portion corresponding to different sized sheets in the transport direction. The sensor portion 22 may be, for example, an optical sensor to detect the size of a sheet by emitting a light and receiving the light reflected by the sheet or a contact sensor to detect the size of a sheet by coming in contact with the sheet placed on the upper surface of the first support portion 16. A detection result of the sensor portions 22 is transmitted to a control portion of the image reading apparatus, and the respective portions of the image reading apparatus are controlled based on the detection result.

Next, the operation of the ADF paper feed tray of the present preferred embodiment will be described.

As shown in FIG. 1 and FIG. 2, in the state where the sheet is placed on the ADF paper feed tray 10, the center portion of the sheet in the width direction is supported from below by the first support portion 16. The outside portion of the sheet positioned outside the center portion of the sheet in the width direction is supported from below by the second support portion 18. Further, both side portions in the width direction of the sheet protruding to the outside from the second support portion 18 hang down substantially uniformly.

In more detail, for example, in the case of the sheet of the JIS standard A4 size (hereinafter referred to as "A4 size") frequently used in the image reading apparatus, in the case of a lateral transport in which the sheet is transported while the short side direction of the sheet is made the transport direction, substantially the whole A4 size sheet is placed on the tray body portion 12. In the case of a longitudinal transport in which the sheet is transported while the long side direction of the sheet is made the transport direction, substantially the whole A4 size sheet is placed on the tray body portion 12, the first support portion 16, and the second support portion 18. That is, the width of the second support portion 18 at a portion connected to the tray body portion 12 and in the direction that is substantially perpendicular to the sheet transport direction is designed to have a size substantially equal to the width of the A4 size sheet in the short side direction. In the case of a sheet size frequently used as stated above, since substantially the whole sheet thereof is supported by the whole surface of the ADF paper feed tray 10, troubles such as skew do not occur at the time of the sheet transport. On the other hand, when the longitudinal transport is performed while the long side direction of a sheet of a large size such as the JIS standard A3 size (hereinafter referred to as "A3 size") is made the transport direction, in case a large paper feed tray capable of supporting the whole sheet is provided, it becomes difficult to take out the sheet which has been read and discharged below, which is not preferable. However, in the case of the ADF paper feed tray 10 of the present preferred embodiment, since both side portions of the sheet in the width direction placed on the ADF paper feed tray 10 hang down uniformly, the sheet is deformed convexly in the width direction, and accordingly, stiffness is provided to the sheet. Thus, it is possible to prevent the sheet from being supplied in an inclined state to the ADF.

By this arrangement, since the first support portion 16 has only to support the center portion of the sheet in the width direction, it can be made small, and the ADF paper feed tray 10 including the first support portion 16 can also be made small. As a result, the unsightliness of the ADF paper feed tray 10 can be minimized. Since the ADF paper feed tray 10 is made small, in the case where the sheet is discharged below the ADF paper feed tray 10, it is possible to facilitate the confirmation of the discharged sheet.

In the state where the sheet is placed on the ADF paper feed tray 10, since both side portions of the sheet in the width direction hang down uniformly, the sheet is deformed convexly in the width direction, and stiffness is provided to the sheet. Accordingly, it is possible to prevent the sheet from being supplied in an inclined state to the ADF. By this arrangement, skew of the sheet can be prevented, and poor image formation can be prevented.

Since the transparent or semi-transparent second support portion 18 is mounted on the first support portion 16 to support, from below, the outside portion of the sheet positioned outside the center portion of the sheet in the width direction, the unsightliness of the ADF paper feed tray 10 is further minimized. Since light is transmitted through the second support portion 18, in the case where the sheet is discharged below the ADF paper feed tray 10, it is possible to further facilitate the confirmation of the discharged sheet.

Further, since the cutout 20 is formed at a portion of the second support portion 18, the sheet can be easily placed on the ADF paper feed tray 10 by inserting the user's hand into a gap formed by the cutout 20. The sheet placed on the ADF paper feed tray 10 can be easily taken out from the ADF paper feed tray 10 by inserting the user's hand into the gap formed by the cutout 20.

Since the plural sensor portions 22 to detect the length of the sheet in the sheet transport direction are provided on the first support portion 16, the length, in the sheet transport direction, of the sheet placed on the first support portion 16 can be detected. By this arrangement, in the case where image information of a sheet placed on the first support portion 16 is printed onto a printing paper, a printing paper with a suitable size can be easily specified. Since the plural sensor portions 22 are provided, even in the case where sheets of various sizes are placed on the first support portion 16, the size of the sheet placed on the first support portion 16 can be certainly detected. Further, since the sensor portions 22 are provided at the portions corresponding to the center portion of the sheet in the width direction and the portions corresponding to different sheet sizes in the transport direction, even in the case where the sheet is placed on the first support portion 16 so that the center of the sheet placed on the first support portion 16 deviates from a center of the first support portion 16, the size of the sheet can be certainly detected.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. An ADF paper feed tray comprising:

a tray body portion;

a first support portion arranged to support a center portion of a sheet in a width direction of the sheet from below, such that side portions of the sheet in the width direction of the sheet hang down substantially uniformly, the first support portion having a first end portion and a second end portion opposite to the first end portion, the first end portion of the first support portion being connected to a central portion in a width direction of the tray body portion at an upstream side of the tray body portion in a sheet transport direction; and a second support portion mounted on the first support portion and arranged to support, from below, a portion of the sheet located outside of the center portion of the sheet in the width direction; wherein surfaces of the tray body portion and the first support portion on which the sheet is disposed and a lower surface of the second support portion are arranged to extend substantially in parallel with each other;

the second support portion includes a portion that extends outwardly from side edges of the first support portion and a portion that extends outwardly from the second end portion of the first support portion opposite to the first end portion of the first support portion that is connected to the central portion of the tray body portion;

a guide portion arranged to guide the side portions of the sheet, the guide portion arranged to be movable in the width direction on an upper surface of the tray body portion; and the second support portion is substantially U-shaped when viewed in a plan view.

2. The ADF paper feed tray according to claim 1, wherein the second support portion is made of a transparent or semi-transparent material.

3. The ADF paper feed tray according to claim 1, further comprising a cutout arranged at a portion of the second support portion.

4. The ADF paper feed tray according to claim 1, further comprising plural sensor portions on the first support portion and arranged to detect a length of the sheet in a sheet transport direction.

5. The ADF paper feed tray according to claim 4, wherein the plural sensor portions are provided at portions of the first support portion corresponding to the center portion of the sheet and portions of the first support portion corresponding to different sized sheets in the transport direction.

6. The ADF paper feed tray according to claim 4, wherein the plural sensor portions are optical sensors.

7. The ADF paper feed tray according to claim 4, wherein the plural sensor portions are contact sensors.

8. An image reading apparatus comprising: an ADF paper feed tray including:

a tray body portion;

a first support portion arranged to support a center portion of a sheet in a width direction of the sheet from below, such that side portions of the sheet in the width direction of the sheet hang down substantially uniformly, the first support portion having a first end portion and a second end portion opposite to the first end portion, the first end portion of the first support portion being connected to a central portion in a width direction of the tray body portion at an upstream side of the tray body portion in a sheet transport direction; and a second support portion mounted on the first support portion and arranged to support, from below, a portion of the sheet located outside of the center portion of the sheet in the width direction; wherein surfaces of the tray body portion and the first support portion on which the sheet is disposed and a lower surface of the second support portion are arranged to extend substantially in parallel with each other;

the second support portion includes a portion that extends outwardly from side edges of the first support portion and a portion that extends outwardly from the second end portion of the first support portion opposite to the first end portion of the first support portion that is connected to the central portion of the tray body portion;

a guide portion arranged to guide the side portions of the sheet, the guide portion arranged to be movable in the width direction on an upper surface of the tray body portion; and the second support portion is substantially U-shaped when viewed in a plan view.

9. The image reading apparatus according to claim 8, wherein the second support portion is made of a transparent or semi-transparent material.

10. The image reading apparatus according to claim 8, further comprising a cutout arranged at a portion of the second support portion.

11. The image reading apparatus according to claim 8, further comprising plural sensor portions provided on the first support portion and arranged to detect a length of the sheet in a sheet transport direction.

12. The image reading apparatus according to claim 11, wherein the sensor portions are provided at portions of the first support portion corresponding to the center portion of the sheet and portions of the first support portion corresponding to different sized sheets in the transport direction.

13. The image reading apparatus according to claim 11, wherein the plural sensor portions are optical sensors.

14. The image reading apparatus according to claim 11, wherein the plural sensor portions are contact sensors.

* * * * *

UNITED STATES PATENT AND TRADEMARK OFFICE

CERTIFICATE OF CORRECTION

PATENT NO. : 7,637,495 B2
APPLICATION NO. : 11/550474
DATED : December 29, 2009
INVENTOR(S) : Motoyoshi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 478 days.

Signed and Sealed this

Ninth Day of November, 2010

David J. Kappos

David J. Kappos
*Director of the United States Patent and Trademark Office*